US006022227A

United States Patent [19]

Huang

[11] Patent Number: 6,022,227

[45] Date of Patent: Feb. 8, 2000

[54] ELECTRICAL CONNECTOR

[75] Inventor: Kuan-Fu Huang, Tu-Chen, Taiwan

[73] Assignee: Hon Hai Precision Ind. Co., Ltd., Taipei Hsien, Taiwan

[21] Appl. No.: 09/330,227

[22] Filed: Jun. 10, 1999

[30] Foreign Application Priority Data

Dec. 18, 1998 [TW] Taiwan ..... 87221149

[51] Int. Cl.[7] ..... H01R 9/09

[52] U.S. Cl. ..... 439/79

[58] Field of Search ..... 439/79

[56] References Cited

U.S. PATENT DOCUMENTS 5,468,154 11/1995 Yip et al. ..... 439/79

*Primary Examiner*—Gary F. Paumen

*Attorney, Agent, or Firm*—Wei Te Chung

[57] ABSTRACT

An electrical connector includes an insulative housing, a number of electrical terminals secured in the housing, a spacer, and a fastening mechanism for connecting the housing to the spacer. The housing forms mounting two arms rearwardly extending from opposite ends thereof. Correspondingly, the spacer forms two support sections at opposite ends thereof. The mounting arms and the support sections are interconnected by the fastening mechanism to integrate the housing and the spacer together. Thus, when the height of the connector requires adjustment, it is unnecessary to design another mold for the entire housing. Only the spacer needs to be molded again resulting in a time and cost efficient manufacturing process.

3 Claims, 6 Drawing Sheets

ELECTRICAL CONNECTOR

BACKGROUND OF THE INVENTION

The subject invention generally relates to an electrical connector, and particularly to an electrical connector having a height which can be changed conveniently and inexpensively.

Referring to FIGS. 1 and 2 of the attached drawings, a conventional connector includes a dielectric housing 10, a spacer 12 and a plurality of electrical terminals (not shown). The housing 10 defines two rows of passageways 16 for receiving the terminals therein, and two mounting arms 18 extending from opposite ends of the housing 10. An elongate protrusion 20 and an L-shaped latch 22 are formed on each mounting arm 18 of the housing 10. The latches 22 project toward each other. The spacer 12 defines a plurality of apertures 24 for the extension of a portion of the terminals therethrough and two recesses 26 at each end for engaging with the latches 22 of the mounting arms 18. Thus, the spacer 12 is attached to the housing 10. However, when the height of the conventional connector requires modification, a new mold for the housing 10 must be created. As known, the housing should be precisely manufactured especially regarding the terminal passageways. It is readily apparent that the adjustment of such parameters complicates manufacture and is time and cost inefficient. Furthermore, the irregular shape of the housing impedes the free flow of molten plastic thereby adversely affecting quality.

SUMMARY OF THE INVENTION

Accordingly, the primary object of the present invention is to provide an electrical connector having a height which can be changed conveniently and inexpensively.

The second object of the present invention is to provide an electrical connector which can be easily and inexpensively manufactured.

The third object of the present invention is to provide an electrical connector having a molded housing of high quality.

The above objects are accomplished by an electrical connector comprising an insulative housing, a spacer, a plurality of electrical terminals secured in the housing and the spacer, and means for fastening the housing to the spacer. The housing includes a mating face and a mounting face, a plurality of terminal passageways defined between the mating face and the mounting face, and a pair of mounting arms each extending from one of two opposite ends of the housing. The spacer has a base section with a plurality of apertures defined therethrough, and a pair of support sections each formed at one of two opposite ends of the base section corresponding to the mounting arms of the housing. Furthermore, the terminals each comprise a contact portion received in the passageways of the housing, and a tail portion retained in the apertures of the spacer. The fastening means includes a first groove defined in each mounting arm of the housing, a second groove defined in each support section of the spacer, and a pair of blades each having locking barbs formed along vertical edges thereof. By inserting the blade into the corresponding grooves of the mounting arms and the support sections, the housing and the spacer are integrated together.

Alternatively, the fastening means may be a recess defined in each mounting arm of the housing, a bore defined in each support section of the spacer, a pair of bolts, and a pair of nuts. The nuts are received in the corresponding recesses of the mounting arm and the bolts are inserted through the corresponding bores of the support section. The nuts and bolts are then tightly riveted together for integrating the housing and the spacer together.

DETAILED DESCRIPTION OF THE PREFERED EMBODIMENT

Figure 1:
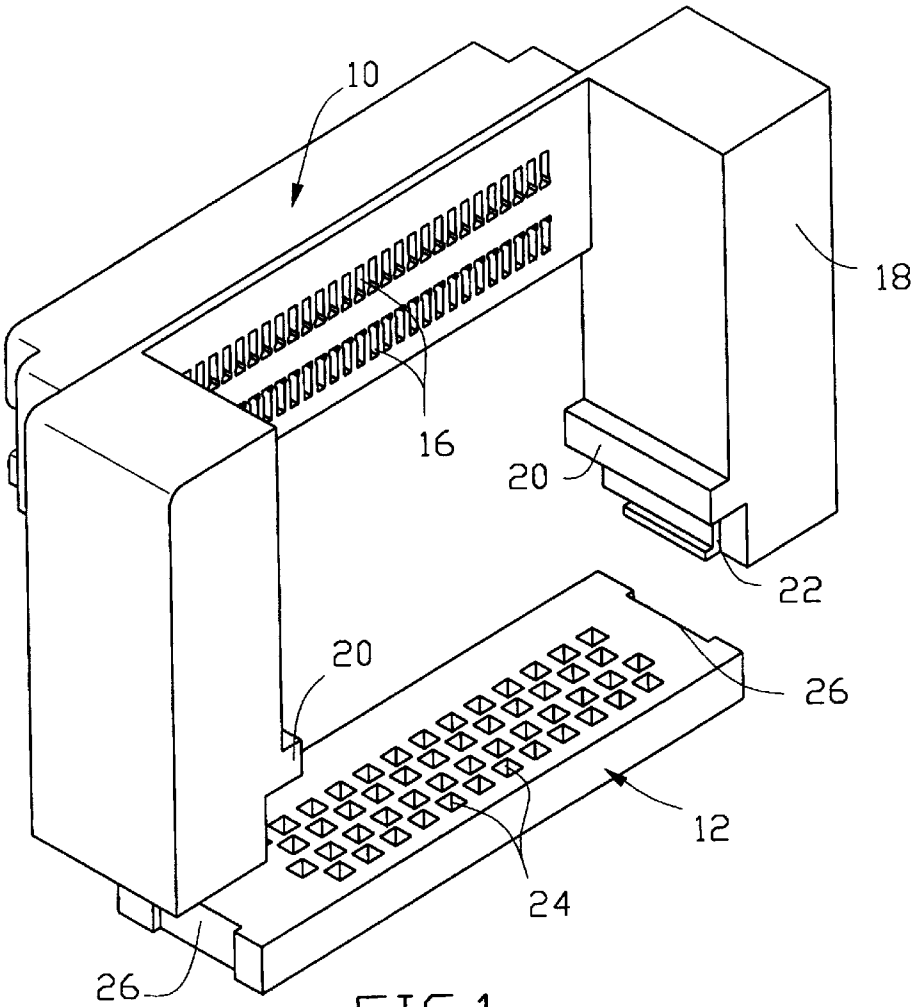
FIG.1 (PRIOR ART)
FIG. 1 is an exploded view of a conventional connector.
Figure 2:
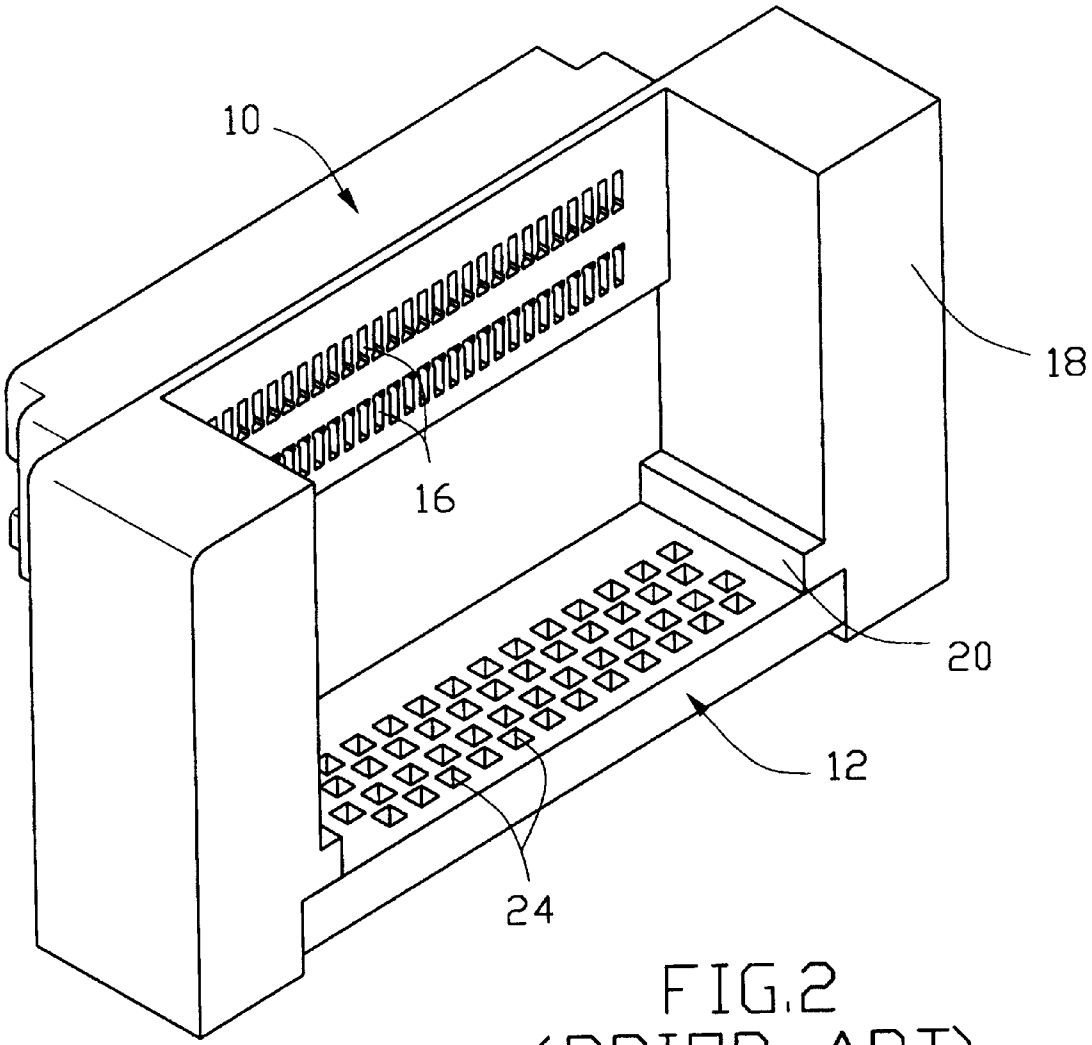
FIG.2 (PRIOR ART)
FIG. 2 is an assembled view of FIG. 1.
Figure 3:
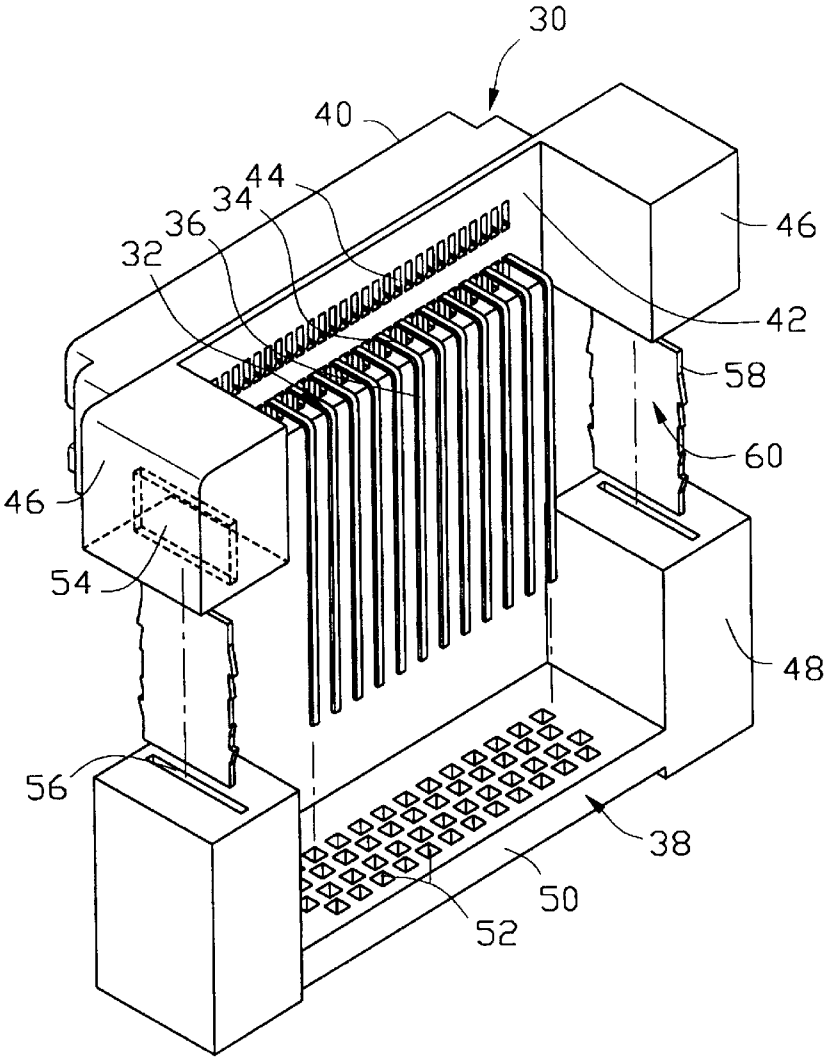
FIG. 3 is an exploded view of an electrical connector according to a first embodiment of the present invention.
Figure 4:
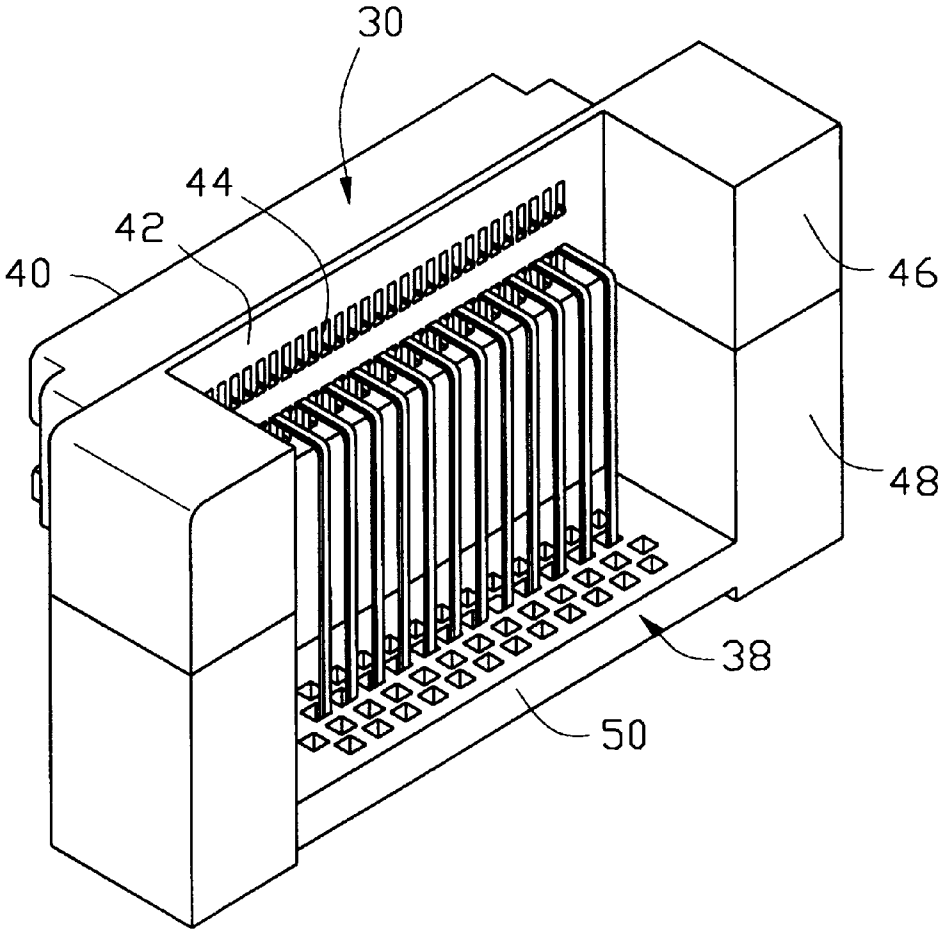
FIG. 4 is an assembled view of FIG. 3.

With reference to FIGS. 3 and 4, an electrical connector in accordance with the present invention comprises a dielectric housing 30, a spacer 38, a plurality of electrical terminals 32, and fastening means (not labeled) for integrating the housing 30 and the spacer 38. The housing 30 includes a mating face 40, a mounting face 42 opposite the mating face 40, a plurality of terminal passageways 44 defined between the mating face 40 and the mounting face 42, and two mounting arms 46 rearwardly extending from opposite ends of the housing 30. The spacer 38 includes a base section 50 defining a plurality of apertures 52 and two support sections 48 upwardly extending from opposite ends of the base section 50. The terminals 32 each have contact portions 34 received in the corresponding passageways 44 of the housing 30, and tail portions 36 retained in the corresponding apertures 52 of the spacer 38, respectively. The fastening means comprises a first groove 54 defined in each mounting arm 46 of the housing 30, a second groove 56 defined in each support section 48 of the spacer 38, and a pair of blades 60 with locking barbs 58 formed along vertical edges thereof.

In assembly, each blade 60 is interferentially fit in the corresponding grooves 54, 56 of the mounting arms 46 and the support sections 48 for integrating the housing 30 and the spacer 38. When the height of the connector requires modification, it is unnecessary to change the entire housing 30. Only the spacer 38 must be remolded. The housing 30 and the spacer 38 can then be interconnected and the height of the connector can be adjusted. As known, the precise manufacture of the housing 30, especially the terminal passageways 44, is much more critical, than that of the spacer 38. The manufacturing method of the connector of the present invention is time and cost efficient. In addition, the shape of the present connector is not complex which facilitates free flow and uniform distribution of molten plastic thereby improving the quality of the manufacturing process of the housing.

Figure 5:
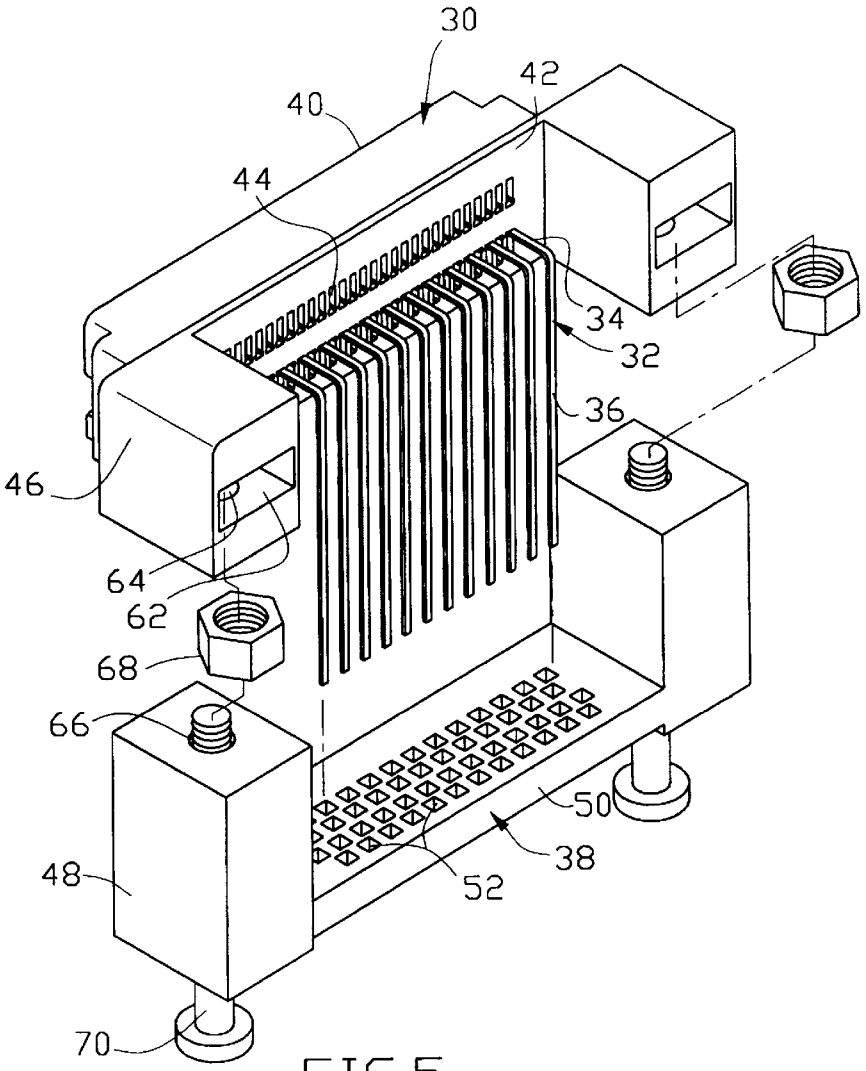
FIG. 5 is an exploded view of an electrical connector according to a second embodiment of the present invention.
Figure 6:
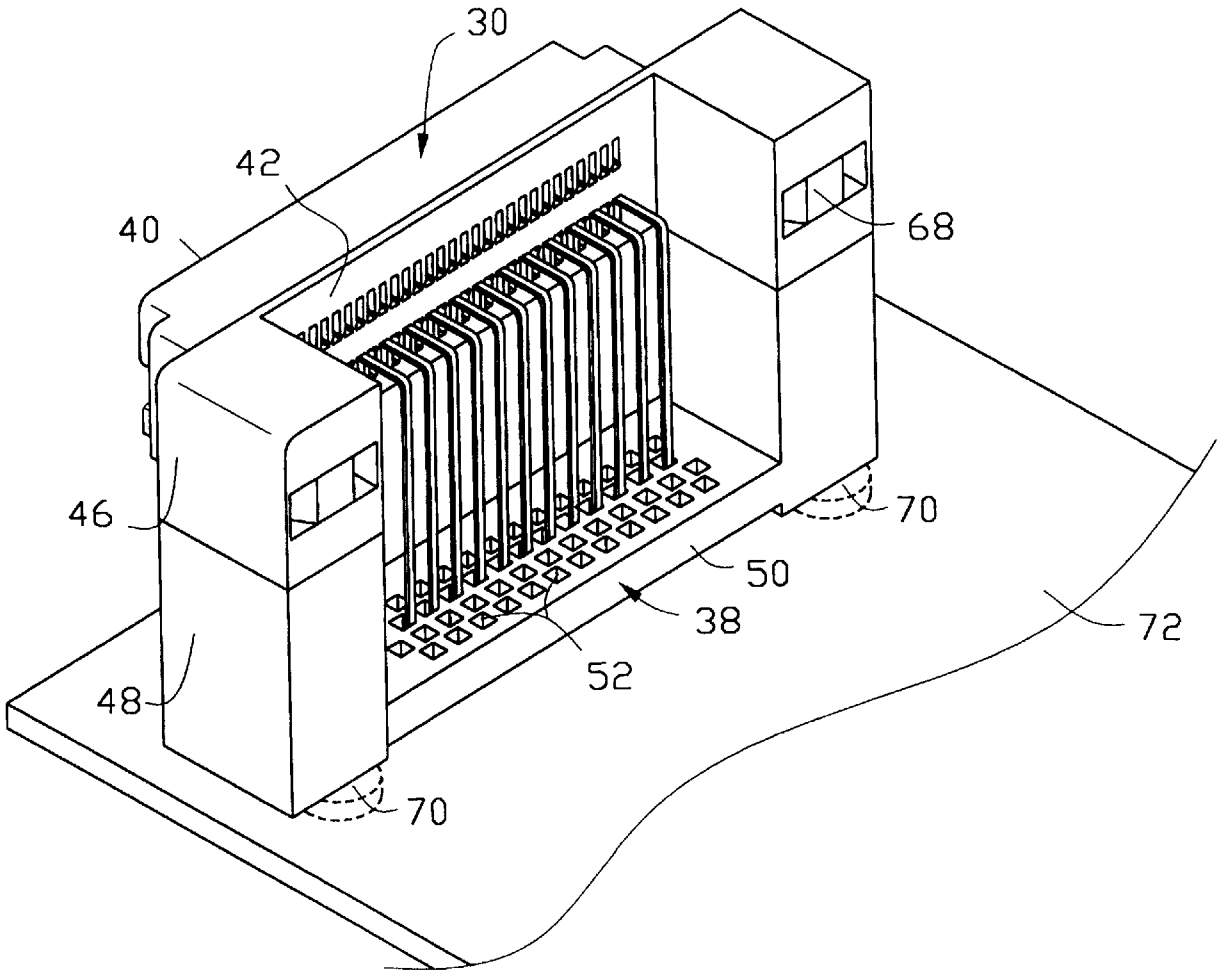
FIG. 6 is an assembled view of FIG. 5.

A second embodiment of the present invention shown in FIGS. 5 and 6 is similar to the first embodiment thereof, except for the fastening means; thus, similar parts are not designated differently. The fastening means comprises a first rectangular recess 62 defined in each mounting arm 46 and a second cylindrical recess 64 communicating therewith, a bore 66 vertically defined through each support section 48 of the spacer 38, a pair of bolts 70, and a pair of nuts 68. In assembly, each nut 68 is received in the corresponding first recess 62 of the arms 46 of the housing 30, and each bolt 70 is received in the corresponding bore 66 of the support sections 48 of the spacer 38. In addition, a lateral face of the nut 68 abuts against an inner face of the recess 62 therefore the nut 68 is secured therein. After riveting the bolt 70 and the nut 68 together, the housing 30 is integrated with the spacer 38. Furthermore, the bolt 70 has a head portion spaced from a bottom of the spacer 38 in a predetermined distance thereby securing a circuit board 72 to the bottom of the spacer 38 within the distance as shown in FIG. 6.

It is noted that because the connectors may be required to have different heights, the support sections 48 of the spacers 38 may provide different height for compliance with the different contact tail portion lengths while still cooperating with the same housing 30 which may be a standard and easy piece to make. This will provide flexible manufacturing capability. It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. An electrical connector comprising:

an insulative housing having a front mating face and a mounting face, a plurality of terminal passageways defined between the mating face and the mounting face, and a pair of mounting arms each formed at one of two opposite ends of the housing;

a spacer having a base section defining a plurality of apertures, and a pair of support sections each formed at one of two opposite ends of the base section;

a plurality of electrical terminals having contact portions received in the passageways of the housing and tail portions received in the apertures of the spacer; and means for fastening the mounting arm of the housing to the support section of the spacer, wherein said fastening means comprises a nut received in one of mounting arm and associated support section and a bolt extending through the other of the mounting arm and associated support section to threadingly engage with the nut.

2. The electrical connector as set forth in claim 1, wherein: said fastening means comprises a first recess defined in the mounting arm of the housing, a second recess in communication with the first recess and a bore defined through the support section of the spacer; and the nut is received in the first recess of the mounting arm and the each bolt extends through the bore of the support section to engage with the nut.

3. The electrical connector as set forth in claim 1, wherein the bolt has a head portion spaced from a bottom of the spacer a predetermined distance.

* * * * *